US006666619B2

(12) United States Patent
Yang

(10) Patent No.: US 6,666,619 B2
(45) Date of Patent: Dec. 23, 2003

(54) PROTECTIVE WALL ASSEMBLY

(76) Inventor: Won-Hoi Yang, Ma-1106, Bangbae Samho-Apt. 725, Bangbae-dong, Seochu-gu, Seoul (KR)

( * ) Notice: Subject to any disclaimer, the term of this patent is extended or adjusted under 35 U.S.C. 154(b) by 0 days.

(21) Appl. No.: 10/128,089

(22) Filed: Apr. 23, 2002

(65) Prior Publication Data

US 2002/0154950 A1 Oct. 24, 2002

(30) Foreign Application Priority Data

Apr. 24, 2001 (KR) ..... 2001-21898

(51) Int. Cl.[7] ..... E02B 3/12; E02B 3/14; E02D 29/00

(52) U.S. Cl. ..... 405/16; 405/19; 405/20; 405/284

(58) Field of Search ..... 405/262, 284, 405/285, 286, 287, 20, 19, 17, 16, 15, 302.6, 30, 31, 282; 52/604, 605, 606, 607, 603

(56) References Cited

U.S. PATENT DOCUMENTS 1,822,602 A * 9/1931 Ross ..... 405/20
3,176,468 A * 4/1965 Shoshichiro et al. ..... 405/29
4,370,075 A * 1/1983 Scales ..... 405/20
5,702,208 A * 12/1997 Hilfiker et al. ..... 405/302.4
5,779,391 A * 7/1998 Knight ..... 405/20

* cited by examiner

*Primary Examiner*—Heather Shackelford
*Assistant Examiner*—Lisa M. Saldano
(74) *Attorney, Agent, or Firm*—Howard & Howard

(57) ABSTRACT

A protective wall assembly (8) for protecting an embankment (6) to prevent scouring of the embankment (6) during high water flows such as experienced in floods or tidal waves. The protective wall assembly (8) comprises a plurality of block assemblies (10) each having a body (11), a top surface (30), and a bottom surface (32). Each block assembly (10) further includes four side faces **(34,34*a*,34*b*,34*c*) interconnected by four intermediate faces (13,13*a*,13*b*,13*c*) to define an eight-sided body. Each intermediate face (13, 13*a*,13*b*,13*c*) has a bore (21,22) extending perpendicularly thereinto. A first connecting device (42) engages the bores (21,22) in a first pair of intermediate faces (13,13*b*) of a first pair of block assemblies (10A,10C). The length of one (21) of the bores (21,22) is different than a length of the other of the bores (21,22). The protective wall assembly (8)** provides an environmentally friendly structure harmonized with the surrounding scenery.

4 Claims, 3 Drawing Sheets

PROTECTIVE WALL ASSEMBLY

RELATED APPLICATIONS

This application claims priority to Korean Patent Application No. 2001-0021898, filed on Apr. 24, 2001.

FIELD OF THE INVENTION

The present invention relates to a protective wall assembly used to protect an embankment. Specifically, the protective wall covers an earthen embankment having an inclined plane to prevent the earthen embankment from being swept away by scouring during periods of high water flow such as in a flood or from tidal waves.

BACKGROUND OF THE INVENTION

Protecting earthen embankments, dykes, or earth-formed walls is important when considering the impact that erosion or scouring from high water flows can have on these structures. As an example, there are many rivers in which the river's shape is formed in accordance with natural water flow and topography by moving soil from an embankment thereby re-shaping the embankment.

In the prior art, to protect the embankment, dyke, or earth-formed wall most of the protective walls are made from stones or stone nets covering the inclined surfaces of the embankments, dykes, or earth-formed walls. The stones or stone nets are used to prevent scouring and protect the embankments, dykes, or earth-formed walls from being swept out by high water flows or rapid water flow. Ultimately, the prior art attempts to prevent destruction caused by high water flows. In particular, destruction during floods and tidal waves.

However, the prior art stones or stone nets are not particularly useful for preventing scouring or for preventing destruction of the embankments, dykes, or earth-formed wall. The stones or stone nets are easily displaced by high water flows and can easily be washed away from the embankment, dyke, or earth-formed wall.

As a result, there is a need in the art to create a protective wall that can withstand the energy generated by high water flows and successfully protect the embankments, dykes, and earth-formed walls.

SUMMARY OF INVENTION

The present invention provides a protective wall assembly. The protective wall assembly comprises a plurality of block assemblies. Each of the block assemblies comprise a body having a top surface and a bottom surface surrounded by four side faces and interconnected by four intermediate faces to define an eight-sided body. Each of the side faces has a recess therein extending transversely to the top and bottom surfaces and each of the intermediate faces has a bore extending perpendicularly thereinto. The assembly further includes a first connecting device to engage the bores in opposing intermediate faces of a first pair of block assemblies wherein a length of one of the bores is different than a length of the other bore.

The protective wall assembly overcomes many of the disadvantages of the prior art. The prior art stones and stone nets fail to provide a secure structure resilient to high water flow rates. The use of the connecting devices of the present invention and the manner in which they are connected increases the resilience of the protective wall assembly to high water flow rates such as those experienced during periods of flooding and by tidal waves.

At the same time, the present invention aims at providing an environmentally friendly protective wall assembly that is in harmony with the surrounding scenery, as well as securely protecting it. As a result, the protective wall assembly of the present invention is conducive to grass and tree planting as illustrated by the attached drawings.

BRIEF DESCRIPTION OF THE DRAWINGS

Advantages of the present invention will be readily appreciated as the same becomes better understood by reference to the following detailed description when considered in connection with the accompanying drawings wherein.

DESCRIPTION OF THE PREFERRED EMBODIMENT

Referring to the Figures, wherein like numerals indicate like or corresponding parts throughout the several views, a protective wall assembly for protecting an embankment 6 is generally shown at 8.

Figure 1:
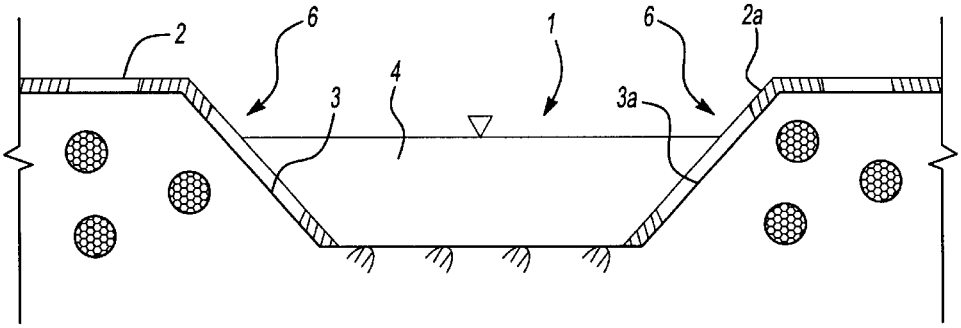
FIG. 1 is a cross-sectional view of a river showing an embankment having an inclined surface.

It is to be appreciated that the protective wall assembly 8 of the present invention can be utilized for a multitude of purposes. In general, the protective wall assembly 8 can be used to construct dams, dykes, railroad bases, roadways, to protect river bottoms, to protect dykes, to protect earthen walls, and the like. However, for illustrative purposes, the protective wall assembly 8 will be described as being used to protect the embankments 6 of a river 1. Referring to FIG. 1, the embankments 6, for illustrative purposes only, are shown as inwardly inclined surfaces 3,3*a* at both sides 2,2*a* of the river 1. In FIG. 1, stones are shown covering the embankments 6. However, as will be described later, a portion of the stones may be removed to construct the protective wall assembly or the protective wall assembly 8 can be constructed over the stones. Flowing water 4 is illustrated on the bottom of the river 1 beside the inclined surfaces 3,3*a* to show the relationship between the water 4 and the embankments 6.

Figure 2:
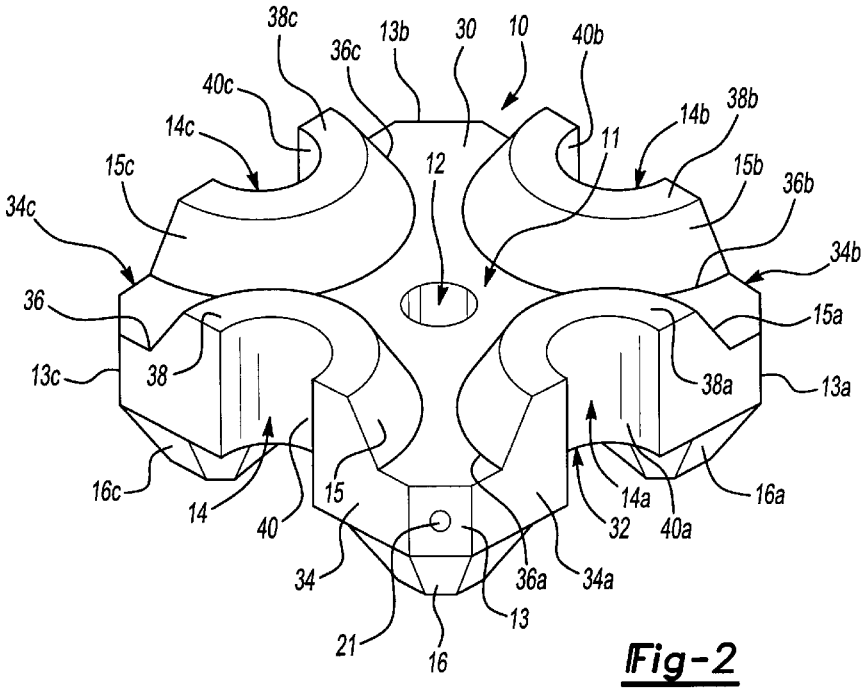
FIG. 2 is a perspective view of a block assembly of the present invention.

The protective wall assembly 8 comprises a plurality of block assemblies 10 to be placed on the inclined surfaces 3,3*a* of the embankments 6. Referring to FIG. 2, each of the block assemblies 10 comprise a body 11 having a top surface 30 and a bottom surface 32 surrounded by four side faces 34,34*a*,34*b*,34*c* interconnected by four intermediate faces 13,13*a*,13*b*,13*c* to define an eight-sided body. Each of the side faces 34,34*a*,34*b*,34*c* has a recess 14,14*a*,14*b*,14*c* therein extending transversely to the top and bottom surfaces 30,32. In the preferred embodiment, the recesses 14,14*a*, 14*b*,14*c* are arcuate in shape. More specifically, each recess 14,14*a*,14*b*,14*c* forms a semi-circle in one of the side faces 34,34*a*,34*b*,34*c*.

Each block assembly 10 includes a collar 15,15*a*,15*b*,15*c* disposed on the top surface 30 so as to define an upward extension of each of the recesses 14,14*a*,14*b*,14*c*. Specifically, four collars 15,15*a*,15*b*,15*c* engage the body 11. Each collar 15,15*a*,15*b*,15*c* has a base 36,36*a*,36*b*,36*c* at the top surface 30 and extends to an upper rim surface 38,38*a*,38*b*,38*c* narrower than the base 36,36*a*,36*b*,36*c*. Furthermore, in the preferred embodiment, each collar 15,15*a*,15*b*,15*c* has a semi-circular shape. More specifically, each collar 15,15*a*,15*b*,15*c* includes an interior surface 40,40*a*,40*b*,40*c* that matches the semi-circular shape of the associated recess 14,14*a*,14*b*,14*c* to form a continuous surface. Preferably, the collars 15,15*a*,15*b*,15*c* are integrally formed with the body 11. However, the collars 15,15*a*,15*b*, 15*c* may also be separate structures connected to the body 11.

Each block assembly 10 includes a protrusion 16,16*a*, 16*b*,16*c* adjacent to, or more specifically, below each of the intermediate faces 13,13*a*,13*b*,13*c*. Each of the protrusions 16,16*a*,16*b*,16*c* extend from the bottom surface 32 of the body 11 and defines a hexagonal frustum. The hexagonal frustums 16,16*a*,16*b*,16*c* project downwardly from the bottom surface 32 of the body 11 to be buried or fixed in the earth on the inclined surfaces 3,3*a* of the embankments 6. As will be appreciated, the hexagonal frustums 16,16*a*,16*b*,16*c* of the block assembly 10 provide secure support of the block assemblies 10 in the earth. Preferably, the frustums 16,16*a*, 16*b*,16*c* are integrally formed with the body 11. However, the frustums 16,16*a*,16*b*,16*c* may also be separate structures connected to the body 11.

The body 11 of each of the block assemblies 10 defines a center hole 12 centrally formed through the body 11 between the top and bottom surfaces 30,32. The center holes 12 are cylindrical and can be used for planting grass and trees or for inserting a warning mark board in the center thereof.

Each of the intermediate faces 13,13*a*,13*b*,13*c* has a bore 21,22 extending perpendicularly thereinto. Specifically, each block assembly 10 has four bores 21,22 with two bores 21 in the intermediate faces 13,13*c* having a different length than the other two bores 22 in the intermediate faces 13*a*,13*b*. For descriptive purposes, two of the bores 21,22 will be hereinafter referred to as short bores 22 and two of the bores 21,22 will be hereinafter referred to as long bores 21. The long bores 21 are formed in a lower end of the body 11 and the short bores 22 are formed in an upper end of the body 11. The bores 21,22 are formed in the intermediate faces 13,13*a*,13*b*,13*c* so that connecting devices 20 can engage the bores 21,22.

Figure 3:
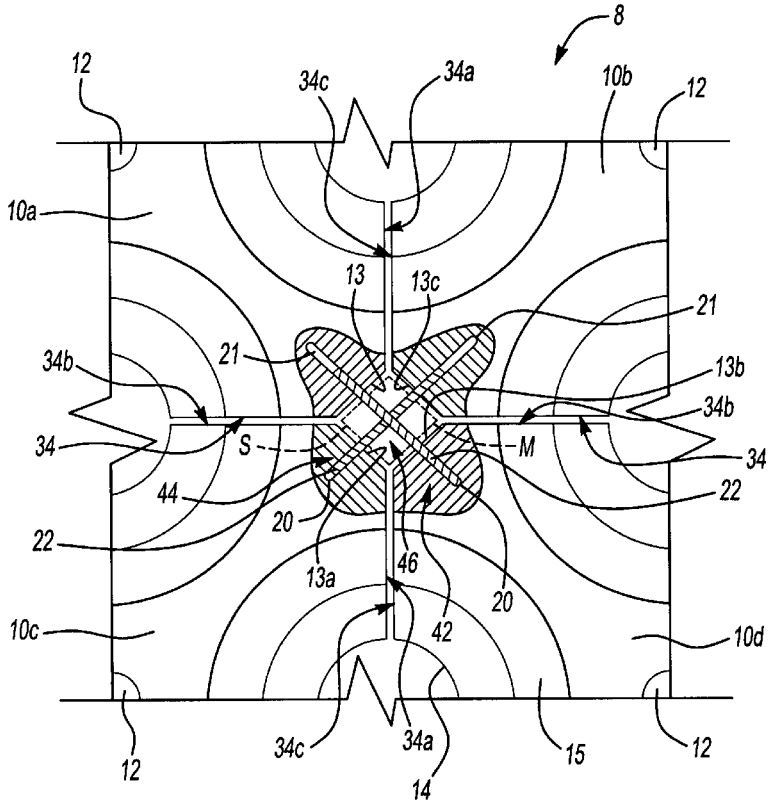
FIG. 3 is a partially cut-away plane view of four abutting block assemblies of the present invention illustrating first and second connecting devices.

Referring to FIG. 3, to construct the protective wall assembly 8, a plurality of the block assemblies 10 are interconnected to one another using the bores 21,22. To describe the construction of the protective wall assembly 8, the relationship between four block assemblies 10 will be described in detail. The four block assemblies are labeled 10A,10B,10C, and 10D. It is to be appreciated that in the preferred embodiment, each of the block assemblies 10A, 10B,10C,10D are identical. However, the protective wall assembly 8 could also be practiced such that each block assembly 10A,10B,10C,10D has a different configuration.

In FIG. 3, block assemblies 10A,10B are positioned in an upper row and block assemblies 10C,10D are positioned in a lower row. For illustrative purposes, FIG. 3 shows the interconnection of four block assemblies 10A,10B,10C, 10D. A first pair of block assemblies 10A,10D are positioned with a first pair of intermediate faces 13,13*b* opposed to one another and disposed in a spaced and parallel relationship to one another. A second pair of block assemblies 10B,10C are positioned with a second pair of intermediate faces 13*a*,13*c* opposed to one another and disposed in a spaced and parallel relationship to one another. The first pair of intermediate faces 13,13*b* are perpendicular to the second pair of intermediate faces 13*a*,13*c* to define a four-sided space S between the first pair of intermediate faces 13,13*b* and the second pair of intermediate faces 13*a*,13*c*.

A first connecting device 42 engages the bores 21,22 in the first pair of intermediate faces 13,13*b* of the first pair of block assemblies 10A,10D and a second connecting device 44 engages the bores 21,22 in the second pair of intermediate faces 13*a*,13*c* of the second pair of block assemblies 10B,10C. The first and second connecting devices 42,44 cross through the space S when engaging the block assemblies 10A,10B,10C,10D. The first connecting device 42 is further defined as a connecting rod 20 for insertion into the bores 21,22 in the first pair of intermediate faces 13,13*b*. The second connecting device 44 is also further defined as a connecting rod 20 for insertion into the bores 21,22 in the second pair of intermediate faces 13*a*,13*c*. Hereinafter, the connecting devices 42,44 shall be referred to as connecting rods 20. The connecting rods 20 are preferably made from metal such as steel, but can be made from any non-corrosive material having high strength for holding the block assemblies 10A,10B,10C,10D together. Such rods are well known in the art for reinforcing concrete structures.

The bore 21 in one of the first pair of intermediate faces 13 is the long bore 21 and the bore 22 in the other of the first pair of intermediate faces 13*b* is the short bore 22. Along the same lines, the bore 21 in one of the second pair of intermediate faces 13*c* is the long bore 21 and the bore 22 in the other of the second pair of intermediate faces 13*a* is the short bore 22. One connecting rod 20 is inserted into the long and short bores 21,22 of the first pair of intermediate faces 13,13*b* and one connecting rod 20 is inserted into the long and short bores 21,22 of the second pair of intermediate faces 13*a*,13*c*. As previously mentioned, the long bore 21 has a length greater than the short bore 22. As such, when the connecting rods 20 are inserted into the bores 21,22, the connecting rods are fully seated in the short bores 22, but only partially seated in the long bores 21. Accordingly, the long bores 21 provide a space for adjusting the connecting rods 20 during construction, as shown in FIG. 3.

In the preferred embodiment, a binding material M is placed in the space S defined by the first and second pair of block assemblies 10A,10B,10C,10D to further secure the connecting rods 20 in the bores 21,22 and to further secure the protective wall assembly 8. The binding material M can comprise cement or mortar or concrete, or any combination thereof, and is designated by a hidden line in FIG. 3. The binding material M may be colored for aesthetic purposes or to characterize a warning sign.

Again referring to FIG. 3, four side faces 34,34*a*,34*b*,34*c* of the block assemblies 10A,10D in the first pair are in a matching and abutting relationship to four side faces 34,34*a*, 34*b*,34*c* of the block assemblies 10B,10C in the second pair. The first pair being in a diagonally opposed relationship to the second pair. The recesses 14,14*a*,14*b*,14*c* and collars 15,15*a*,15*b*,15*c* of the side faces 34,34*a*,34*b*,34*c*, in a matching and abutting relationship, define a planting space P. (See FIGS. 4 and 5). The planting space P is cylindrical in shape. The planting space P can be used to facilitate the planting of trees or grass, as shown in the blow-up of FIG. 4, or for inserting the warning mark board after the protective wall assembly 8 has been constructed. Alternatively, the planting space P can simply provide a conduit for grasses and the like to grow naturally.

Figure 4:
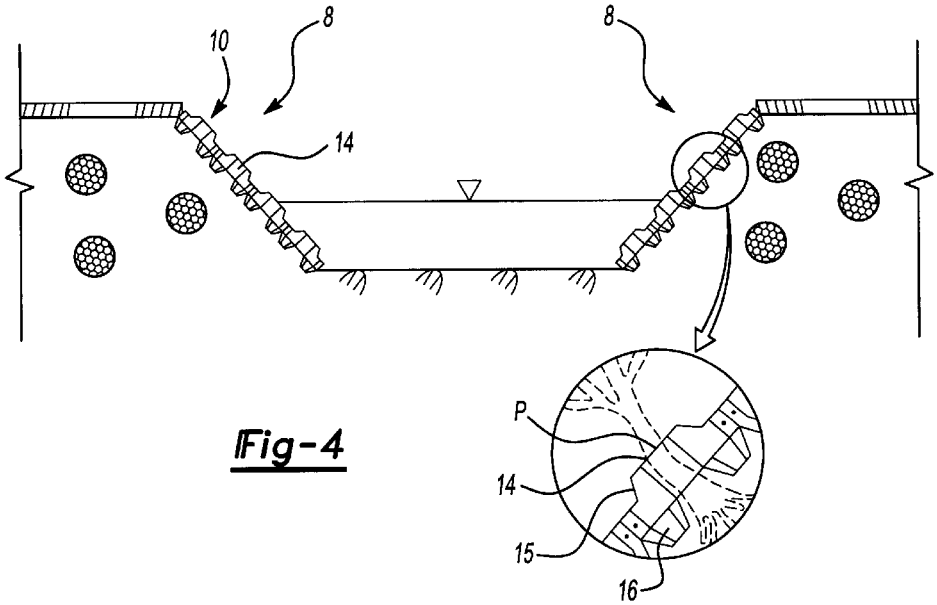
FIG. 4 is a cross-sectional view of the river illustrating a protective wall assembly comprising the block assemblies.
Figure 5:
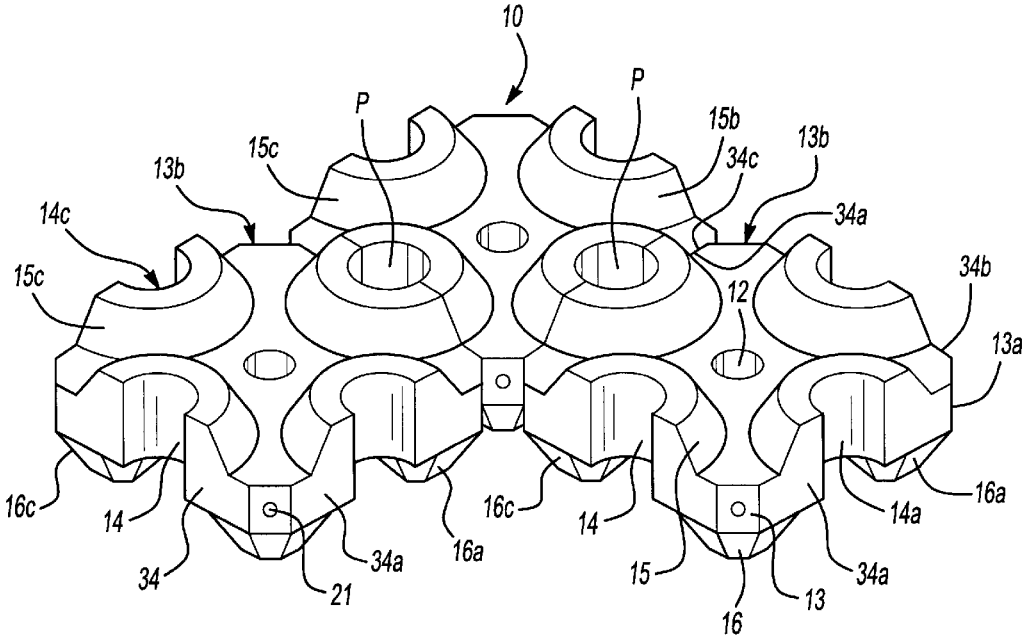
FIG. 5 is a perspective view illustrating partial construction of the protective wall assembly.

Referring to FIGS. 3, 4, and 5, construction of the protective wall assembly 8 using the connecting devices 42,44 to secure the protective wall assembly 8 such that the protective wall assembly 8 protects the embankment 6 will now be described. The first pair of block assemblies 10A, 10D having the first pair of intermediate faces 13,13*b* are positioned along the embankment 6 and the second pair of block assemblies 10B,10C having the second pair of intermediate faces 13*a*,13*c* are positioned along the embankment 6. The block assemblies 10A,10B,10C,10D are arranged such that the second pair of intermediate faces 13*a*,13*c* are perpendicular to the first pair of intermediate faces 13,13*b* to define the space S. As previously described, the first pair of block assemblies 10A,10D are interconnected using the first connecting device 42 and the second pair of block assemblies 10B,10C are interconnected using the second connecting device 44.

Interconnecting the first and second pair of block assemblies 10A,10B,10C,10D is further defined as diagonally inserting the connecting rods 20 into the bores 21,22 in each of the block assemblies 10A,10B,10C,10D of the first and second pair of block assemblies 10A,10B,10C,10D such that both the connecting rods 20 pass through the space S, as previously described.

Construction of the protective wall assembly 8 further includes crossing the connecting rods 20 whereby the connecting rod 20 interconnecting the first pair of block assemblies 10A,10D crosses over the connecting rod 20 interconnecting the second pair of block assemblies 10B,10C to define a cross 46 and the cross 46 is in the space S. The cross-linking of the block assemblies 10A,10B,10C,10D serves to further secure the protective wall assembly 8. It is to be appreciated that the connecting rods 20 can be crossed in the same plane, or the connecting rods 20 can cross in different planes. In the case of crossing in different planes, the bores 21,22 in the first pair of intermediate faces 13,13*b* can be formed either lower or higher relative to the bores 21,22 in the second pair of intermediate faces 13*a*,13*c* to accommodate crossing of the connecting rods 20. In this manner, the bottom surfaces 32 of the four block assemblies 10A,10B,10C,10D remain coplanar when positioned along the embankment 6.

The cylindrical planting space P is formed between abutting side faces 34,34*a*,34*b*,34*c* of the first and second pair of block assemblies 10A,10B,10C,10D and the binding material M is filled in the space S in which the connecting rods 20 cross. The binding material M is filled in the space S between the top and bottom surfaces 30,32 and further secures and fixes the connecting rods 20 in position in the block assemblies 10A,10B,10C,10D. The binding material M may be colored.

The block assemblies 10 of the present invention may be mass-produced, as single, identical, concrete units interconnected by the connecting devices 42,44 and secured by the binding material M. The block assemblies 10 can also be made from colored concrete. It is to be further appreciated that all of the block assemblies 10 in the preferred embodiment are identical. In addition, it is to be appreciated that the protective wall assembly 8 of the present invention can comprise tens to hundreds of block assemblies 10 arranged similarly to those described above. However, for ease of description, only the relationship between the four block assemblies 10A,10B,10C,10D has been provided in detail. The block assemblies 10 when assembled with other block assemblies 10 to form the protective wall assembly 8 can be either partially exposed with only the protrusions 16,16*a*, 16*b*,16*c* fixed in the earth, or the protective wall assembly 8 can be covered by soil or stone. Furthermore, the protective wall assembly 8 can be constructed by first removing the layer of stones along the embankment 6 and securing the protective wall assembly 8 in soil below.

The configuration of the first and second pairs of intermediate faces 13,13*a*,13*b*,13*c* having bores 21,22 and the colored binding material M filled in the space S formed by the four intermediate faces 13,13*a*,13*b*,13*c* of the four block assemblies 10A,10B,10C,10D, together with the semi-circular recesses 14,14*a*,14*b*,14*c* and the collars 15,15*a*,15*b*, 15*c*, result in a unified structure, harmonized with the surrounding environment. The planting spaces formed by the semi-circular recesses 14,14*a*,14*b*,14*c* and the inner surfaces of the collars 15,15*a*,15*b*,15*c* communicate with the earth so that planting the trees or flowers or inserting the warning mark board in the planting spaces P is possible. The effect of which is an environmentally friendly structure to potentially provide green space or leisure areas for citizens and residents.

Obviously, many modifications and variations of the present invention are possible in light of the above teachings. The invention may be practiced otherwise than as specifically described within the scope of the appended claims.

What is claimed is:

1. A protective wall assembly (8) comprising:

a plurality of block assemblies (10) with each comprising a body (11) having a top surface (30) and a bottom surface (32) surrounded by a plurality of side faces (34,34*a*,34*b*,34*c*) interconnected by a plurality of intermediate faces (13,13*a*,13*b*,13*c*), each of said side faces (34,34*a*,34*b*,34*c*) defining a recess (14,14*a*,14*b*,14*c*) therein extending transversely to said top and bottom surfaces (30,32) and each of said intermediate faces (13,13*a*,13*b*,13*c*) having a bore (21,22) extending thereinto;

a first connecting device (42) interconnecting a first pair (10A,10D) of said plurality of block assemblies (10) by engaging a first pair of said bores (21,22) in a first pair (13,13*b*) of said intermediate faces (13,13*a*,13*b*,13*c*) wherein one of said first pair of said bores (21,22) has a length different than a length of the other of said first pair of said bores (21,22);

a second connecting device (44) interconnecting a second pair (10B,10C) of said plurality of block assemblies (10) by engaging a second pair of said bores (21,22) in a second pair (13*a*,13*c*) of said intermediate faces (13,13*a*,13*b*,13*c*) wherein one of said second pair of said bores (21,22) has a length different than a length of the other of said second pair of said bores (21,22); and wherein said first pair (13,13*b*) of said intermediate faces (13,13*a*,13*b*,13*c*) are opposed to one another and said second pair (13*a*,13*c*) of said intermediate faces (13, 13*a*,13*b*,13*c*) are opposed to one another and perpendicular to said first pair (13,13*b*) of said intermediate faces (13,13*a*,13*b*,13*c*) to define a four-sided space (S) between said plurality of block assemblies (10) with said first (42) and second (44) connecting devices crossing therethrough.

2. The assembly as set forth in claim 1 further including a binding material (M) placed in said space (S).

3. The assembly as set forth in claim 2 wherein said binding material (M) comprises cement and is colored.

4. A block assembly (10) for forming a protective wall assembly (8), comprising:

a body (11) defining a center hole (12) and having a top surface (30), a bottom surface (32), and four side faces (34,34*a*,34*b*,34*c*) interconnected by four intermediate faces (13,13*a*,13*b*,13*c*), each of said four side faces (34,34*a*,34*b*,34*c*) defining a recess (14,14*a*,14*b*,14*c*) with an arcuate shape and each of said four intermediate faces (13,13*a*,13*b*,13*d*) defining a bore (21,22) wherein two of said bores have a different length than the other two of said bores;

four collars (15,15*a*,15*b*,15*c*) engaging said body (11), each having a base (36,36*a*,36*b*,36*c*) at said top surface (30) and extending to an upper rim surface (38,38*a*,38*b*,38*c*) narrower than said base (36,36*a*,36*b*,36*c*), each collar (15,15*a*,15*b*,15*c*) defining an upward extension of said recesses (14,14*a*,14*b*,14*c*);

four protrusions (16,16*a*,16*b*,16*c*) adjacent to said four intermediate faces (13,13*a*,13*b*,13*c*), each disposed on said bottom surface (32) and extending downwardly from said bottom surface (32) to define a frustum having a hexagonal shape; and at least one connecting rod (20) inserted into at least one of said bores (21,22) defined in said four intermediate faces (13,13*a*,13*b*,13*c*) for forming the protective wall assembly.

* * * * *